US006109694A

United States Patent [19]

Kurtz

[11] Patent Number: 6,109,694

[45] Date of Patent: Aug. 29, 2000

[54] CHAIR WITH FOUR-BAR LINKAGE FOR SELF-ADJUSTING BACK TENSION

[75] Inventor: Eric J. Kurtz, Rock Island, Ill.

[73] Assignee: HON Technololgy, Inc., Muscatine, Iowa

[21] Appl. No.: 09/323,652

[22] Filed: Jun. 1, 1999

[51] Int. Cl.[7] ..... A47C 1/032

[52] U.S. Cl. ..... 297/320; 297/300.2

[58] Field of Search ..... 297/300.2, 300.4, 297/300.5, 316, 320, 321

[56] References Cited

U.S. PATENT DOCUMENTS

| | | | |
|---|---|---|---|
| 868,052 | 10/1907 | Wilmut | 297/320 |
| 2,083,838 | 6/1937 | Goenen . | |
| 2,796,918 | 6/1957 | Luckhardt | 297/321 |
| 3,602,537 | 8/1971 | Kerstholt et al. . | |
| 3,869,172 | 3/1975 | James et al. | 297/316 |
| 4,478,454 | 10/1984 | Faiks . | |
| 4,502,729 | 3/1985 | Locher | 297/320 X |
| 4,685,730 | 8/1987 | Linguanotto | 297/320 X |
| 4,765,679 | 8/1988 | Lanuzzi et al. . | |
| 5,318,345 | 6/1994 | Olson . | |
| 5,486,036 | 1/1996 | Koepke et al. | 297/320 |
| 5,826,940 | 10/1998 | Hodgdon . | |

*Primary Examiner*—Peter R. Brown
*Attorney, Agent, or Firm*—Jones, Day, Reavis & Pogue

[57] ABSTRACT

A control mechanism for a chair having a seat and back includes a first rigid member having a forward end and a rearward end with a first pivot mechanism provided proximate the forward end and a second pivot mechanism provided proximate the rearward end. A second rigid member has a forward end and a rearward end with the forward end being pivotably connected to the first pivot mechanism and with a third pivot mechanism provided proximate the rearward end. The second rigid member is secured to an underside of the seat. A third rigid member is provided having an upper end and a lower end with the lower end being pivotably connected to the third pivot mechanism. A fourth rigid member is provided having an upper end and a lower end, the upper end being rigidly connected to the third rigid member and the lower end being pivotably connected to the second pivot mechanism of the first rigid member. The upper end of the third rigid member is pivotably connected to the back of the chair. Thereby, shifting of a user's position on the seat provides a self-adjusting back tension feature of the chair.

10 Claims, 2 Drawing Sheets

CHAIR WITH FOUR-BAR LINKAGE FOR SELF-ADJUSTING BACK TENSION

BACKGROUND OF THE INVENTION

1. Field of the Invention

The present invention relates generally to a mechanism for connecting the seat and back of a chair to permit predetermined relative movement thereof and, more particularly, to a novel four bar linkage mechanism which provides for self-adjusting back tension of a chair as a user is seated therein.

2. Description of the Related Art

Seating articles, such as chairs, often include mechanisms to provide position adjustment of various parts of the chairs. This is particularly true of chairs used in office environments where office workers are frequently seated over long periods of time. These adjustments can include, for example, modification of the chair seat relative to floor level, modification of the chair back rest angle relative to an initial vertical position, and modification of chair seat angle relative to an initial horizontal position. All of these adjustments can contribute to the comfort of the chair user by selectively altering the user's body position when seated. Typically, these adjustments are accomplished by chair control mechanisms which include linkage systems of various types including spring biasing means.

One type of prior art chair control is illustrated in U.S. Pat. No. 2,272,980. This type of control permits the back of the chair to tilt while the chair seat is maintained in a fixed position. However, a drawback of this arrangement is that the seat is not at all adjustable. Further, the position of the chair back cannot be varied when the chair is in its task position.

Another form of chair control that has proved to be comfortable for the user is disclosed in early U.S. Pat. No. 2,083,838. This patent illustrates a body weight actuated chair wherein the back rest is adapted to be automatically adjusted to the back of the occupant when the occupant is positioned on the seat of the chair. This allows the user to recline somewhat in the chair while his or her feet remain placed on the floor. The weight of the user's body against the chair back acts through a slide mechanism to raise the seat back. While this construction allows for a degree of comfort to the user a disadvantage of the chair is that the slide mechanism is subject to wear and consequent binding over periods of use. Therefore, in practice it has a somewhat limited life and is lacking in reliability. Accordingly, it is desirable to provide a novel chair control mechanism which permits self-adjusting tension of the back of the chair. It is further desirable to provide such a mechanism which is operable solely in response to weight shift by the chair user on the seat of the chair. Still further, it is desirable to provide such a mechanism which is readily manufacturable and reliable in use.

SUMMARY OF THE INVENTION

The present invention improves over the prior art by providing a control mechanism for a chair having a seat and back, including a first rigid member having a forward end and a rearward end with a first pivot mechanism provided proximate the forward end and a second pivot mechanism provided proximate the rearward end. A second rigid member has a forward end and a rearward end with the forward end being pivotably connected to the first pivot mechanism and with a third pivot mechanism provided proximate the rearward end. The second rigid member is secured to an underside of the seat. A third rigid member is provided having an upper end and a lower end with the lower end being pivotably connected to the third pivot mechanism. A fourth rigid member is provided having an upper end and a lower end, the upper end being rigidly connected to the third rigid member and the lower end being pivotably connected to the second pivot mechanism of the first rigid member. The upper end of the third rigid member is pivotably connected to the back of the chair. Thereby, shifting of a user's position on the seat provides a self-adjusting back tension feature of the chair.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
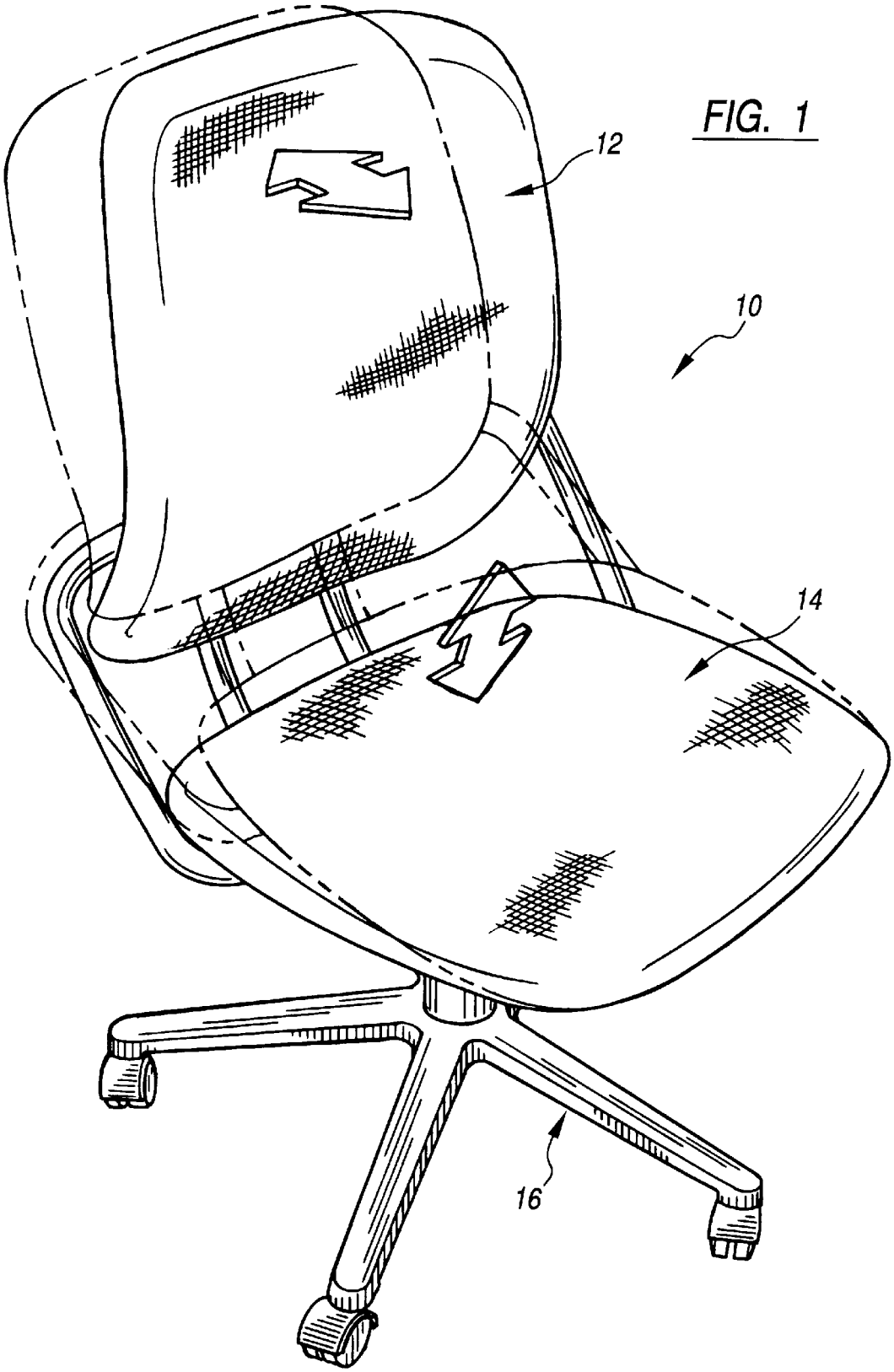
FIG. 1 is a front perspective view of a chair constructed in accordance with the principles of the invention.

Referring now to the drawings, and initially to FIG. 1, a chair constructed according to the principles of the invention is designated generally by the reference numeral 10. The chair 10 is of a type suitable for use in an office environment, for example, and includes as its principal components an upholstered back 12 and seat 14, the seat 14 being supported as will be described hereinafter on a suitable swivel base assembly 16.

Figure 2:
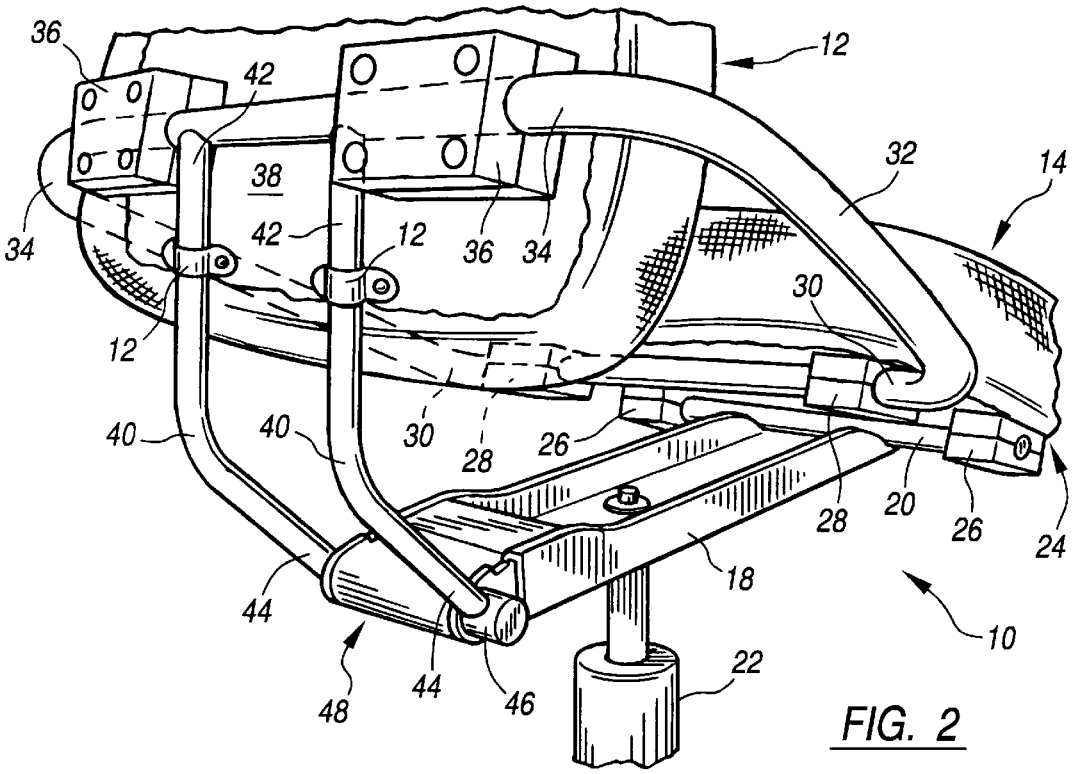
FIG. 2 is a partial rear perspective view of the chair shown in FIG. 1.

FIG. 2 illustrates operation of the chair 10 in terms of the relative movement of the seat 14 and back 12. A bracket 18 is provided having a transverse tube 20 attached thereto at its forward end. The bracket 18 is supported by a centrally positioned pedestal 22 connected to the base assembly 16 in a manner well-known in the art. The bracket 18 is constructed as to be a rigid member which may be referred to hereinafter as a first rigid member. Secured to an underside 24 of the seat 14 are a pair of spaced forward bearing blocks 26 which are suitably dimensioned and configured to journal the seat 14 for limited rotation, or pivoting, on the tube 20. For purposes of describing the invention hereinafter, the underside 24 of the seat may be referred to as a second rigid member.

Also attached to the underside 24 of the seat 14 toward the rear thereof are a pair of spaced rear being blocks 28. The bearing blocks 28 are dimensioned and configured to journal for limited rotation, or pivoting, lower end portions 30 of a tube member 32, which may be referred to hereinafter as a third rigid member. In turn, upper end portions 34 of the tube member 32 are journalled for limited rotation by spaced bearing blocks 36 fixed to a rear surface 38 of the chair back 12. A pair of tube members 40, which may hereinafter be referred to collectively as a fourth rigid member, are connected at upper ends 42 to the tube member 32. Lower end portions 44 of the tube members 40 are attached to a transverse tube member 46 which is journalled for limited rotation, or pivoting, on a rearward end portion 48 of the bracket 18. The tube members 40 may be secured to the rear surface 38 of the chair back 12 by brackets 50 or other suitable means.

Figure 3:
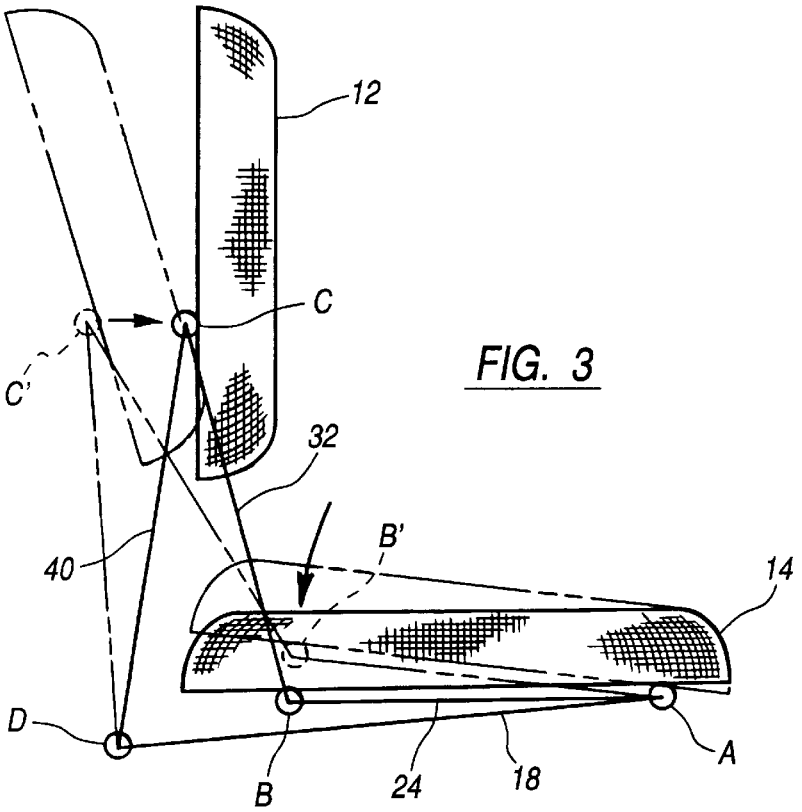
FIG. 3 is a side schematic view of a chair constructed according to the invention showing the relative movement of the chair back and seat.

FIG. 3 illustrates in simple schematic form the operation of the chair 10. First rigid member 18 is connected at pivot point A to the second rigid member 24, which, once again, may be a rigid underside of the seat 14. The second rigid member 24 is connected at pivot point B to the third rigid member 32. The third rigid member 32 is connected at pivot point C to the fourth rigid member 40. The fourth rigid member 40 is connected at pivot point D to the first rigid member 18. In operation, as the chair user adjusts his or her position, the weight of the user on the rear of the seat 14 may be reduced from the weight placed thereon in a normal rest or task position. Correspondingly, the back 12 of the chair 10 may be easily pivoted rearwardly to the position shown as 14 in FIG. 3 as the rear of seat lifts to the position 14'. Through this relative motion, pivot point B will be raised to B' and pivot point C will move rearwardly to C' as the rigid members 24 and 40 pivot on points A and D, respectively.

It can now be appreciated that a chair 10 constructed according to the principles of the invention offers considerable advantages in terms of comfort to the user where it is desired that the user have the ability to alter his or her position in the chair 10 such as when seated over an extended period of time. It can further be appreciated that the chair 10 can be made to change relative seat and back positioning by mere adjustment of body position of the user without the need for counterbalancing spring mechanisms or the like. Thus, the chair 10 has self-adjusting back tension. While the chair 10 has been illustrated in FIGS. 1 and 2 using one configuration of rigid tubular linkage members, it will be appreciated that a variety of configurations of the rigid members are possible, particularly where it is desired to achieve an aesthetically pleasing chair appearance, provided the chair 10 functions basically as illustrated generally in FIG. 3. Further, the illustrated bearing blocks may be replaced by other suitable pivot means to achieve a desired chair look. It can further be appreciated that the second rigid member 24 may be a separate member secured to an underside of the seat 14 as illustrated in FIG. 3, or the seat 14 itself can serve as the second rigid member 24 as illustrated in FIG. 2.

While the invention has been described in connection with preferred embodiments thereof, it will be apparent to those skilled in the art that many changes and modifications may be made without departing from the true spirit and scope of the invention. Accordingly, it is intended by the appended claims to cover all such changes and modifications as come within the spirit and scope of the invention.

What is claimed is:

1. A control mechanism for a chair having a seat and back comprising:

a first rigid member having a forward end and a rearward end with first pivot means provided on said first rigid member proximate said forward end and with second pivot means provided on said first rigid member proximate said rearward end;

a second rigid member having a forward end with third pivot means provided on said second rigid member proximate said rearward end, said forward end of said second rigid member being pivotably connected to said first pivot means;

said second rigid member being secured to an underside of said seat;

a third rigid member having an upper end and a lower end, said lower end being pivotably connected to said third pivot means; and a fourth rigid member having an upper end and a lower end, said upper end being rigidly connected to said third rigid member and said lower end being pivotably connected to the second pivot means of said first rigid member;

said upper end of said third rigid member being pivotably connected by fourth pivot means to the back of the chair;

wherein shifting of a user's position on the seat of the chair causes self-adjusting back tension of the back of the chair.

2. The control mechanism of claim 1 wherein said third rigid member is secured to the back of the chair.

3. The control mechanism of claim 1 wherein said first rigid member is supported on a pedestal.

4. The control mechanism of claim 1 wherein said first pivot means is disposed proximate a forward end of said seat.

5. The control mechanism of claim 1 wherein said second pivot means is disposed proximate a rearward end of said seat.

6. The control mechanism of claim 1 wherein the pivotable connection between said first and fourth rigid members is disposed rearwardly of said chair from said second pivot means.

7. The control mechanism of claim 1 wherein said first rigid member is a bracket and said first pivot means includes a tubular member disposed transversely of said bracket and cooperating with a pair of spaced bearing blocks.

8. The control mechanism of claim 1 wherein said second pivot means includes a pair of spaced bearing blocks secured to said underside of said seat.

9. A control mechanism for a chair having a seat and back comprising:

a first rigid member having a forward end and a rearward end with first pivot means provided on said first rigid member proximate said forward end and with second pivot means provided on said first rigid member proximate said rearward end;

a second rigid member having a forward end and a rearward end with third pivot means provided on said second rigid member proximate said rearward end, said forward end of said second rigid member being pivotably connected to said first pivot means;

a third rigid member having an upper end and a lower end, said lower end being pivotably connected to said third pivot means; and a fourth rigid member having an upper end and a lower end, said upper end being connected to the upper end of said third rigid member and said lower end being pivotably connected to the second pivot means provided on said first rigid member;

said upper end of said third rigid member being connected by fourth pivot means to the back of the chair;

said second rigid member comprising a portion of said seat;

wherein shifting of a user's position on the seat of the chair causes self-adjusting back tension of the back of the chair.

10. The chair of claim 9 wherein said first pivot means includes a tubular member disposed transversely of said first rigid member and said tubular member cooperates with at least one bearing block secured to an underside of said seat.

* * * * *